United States Patent [19]

Sakatani et al.

[11] Patent Number: 4,540,499

[45] Date of Patent: Sep. 10, 1985

[54] FABRIC TREATING COMPOSITION FOR ADDITION TO GRANULAR DETERGENT

[75] Inventors: Takenobu Sakatani, Chiba; Shigeru Suzuki, Ichikawa, both of Japan

[73] Assignee: Lion Corporation, Sumida, Japan

[21] Appl. No.: 509,726

[22] Filed: Jun. 30, 1983

[30] Foreign Application Priority Data

Jul. 5, 1982 [JP] Japan ..... 57-116581

[51] Int. Cl.[3] ..... D06M 13/46

[52] U.S. Cl. ..... 252/8.75; 252/8.8; 252/174.17

[58] Field of Search ..... 252/8.75, 8.8 R, 174.17, 252/528, 547

[56] References Cited

U.S. PATENT DOCUMENTS

| | | | |
|---|---|---|---|
| 3,360,470 | 12/1967 | Wixon | 252/99 |
| 3,920,561 | 11/1975 | DesMarais | 252/8.8 |
| 3,928,213 | 12/1975 | Temple et al. | 252/8.8 |
| 3,962,121 | 6/1976 | Takaku et al. | 252/363.5 |
| 4,136,038 | 1/1979 | Pracht et al. | 252/8.8 |
| 4,395,342 | 7/1983 | Strauss | 252/8.75 |

FOREIGN PATENT DOCUMENTS 2408636 9/1974 Fed. Rep. of Germany .

*Primary Examiner*—Prince E. Willis

*Attorney, Agent, or Firm*—Armstrong, Nikaido, Marmelstein & Kubovcik

[57] ABSTRACT

An additive composition for a granular detergent comprising:

(a) a cationic surfactant having the general formula (I)

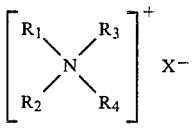

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 5 mole oxyalkylene units, and X represents a halogen atom,

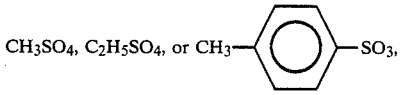

and (b) a nonionic cellulose derivative, the ratio of component (a)/component (b) in a weight basis of 99.9/0.1 to 50/50.

This additive composition can provide an excellent soft finish or touch to fabrics, especially cotton fabrics to be washed while simultaneously washing the fabrics during a fabric laundering operation when this additive composition is incorporated into a granular detergent.

4 Claims, No Drawings

FABRIC TREATING COMPOSITION FOR ADDITION TO GRANULAR DETERGENT

BACKGROUND OF THE INVENTION

1. Field of the Invention

The present invention relates to an additive composition suitable for use in the compounding of a granular detergent. More specifically, the present invention relates to an additive composition for a granular detergent, especially for a granular detergent containing an anionic surfactant, capable of providing an excellent soft finish or touch in fabrics to be washed while simultaneously washing the fabrics during a fabric laundering operation.

2. Description of the Prior Art

Heretofore, when fabrics are washed at home, a soft finish has generally been afforded to fabrics by first washing fabrics with conventional detergents and, then, treating the fabrics with a softening agent containing as a main ingredient a cationic surfactant such as a quaternary ammonium salt after rinsing the washed fabrics with a large amount of water. However, these soft finishing operations are troublesome and time-consuming. Accordingly, it is desired by consumers to develop a detergent composition capable of simultaneously washing and softening fabrics to be washed.

It is known that only slightly water-soluble di (long chain alkyl) type quaternary ammonium salts can exhibit an excellent soft finish and antistatic effects in fabric laundering operations. However, when di (long chain alkyl) type quaternary ammonium salts are used together with detergent compositions, it is difficult to obtain the desired soft finish and antistatic effects in the case of cotton fabrics, although softening effects can be obtained in the case of synthetic fiber fabrics (e.g., nylon and polyester fabrics). This is because, since home laundering detergents generally contain as a main ingredient anionic surfactants, quaternary ammonium salts added to the laundering system are attacked by the anionic surfactants in the detergents before the quaternary ammonium salts are absorbed into cotton fabrics. As a result, the quaternary ammonium salts loose their ionic properties and are stably dispersed in the laundering system and, therefore, it becomes difficult for the quaternary ammonium salts to be absorbed into cotton fabrics. Thus, the desired soft finish effects cannot be obtained.

Various attempts have been made to provide the desired softening effects in cotton fabrics even when quaternary ammonium salts are added to detergent solutions during fabric laundering operations. For instance, it has been proposed that quaternary ammonium salts be granulated or coated with inorganic or organic salts, or organic dispersing retarders to retard the swelling and dispersion of the quaternary ammonium salts in the detergent solution, as disclosed in Japanese Examined Patent Publication (Kokoku) No. 36-8927, U.S. Pat. No. 4073735, and Japanese Unexamined Patent Publication (Kokai) Nos. 55-86895, 53-41312, and 49-98403. However, the softening effects in cotton fabrics obtained from these methods are still insufficient, although a certain degree of improvement is obtained.

SUMMARY OF THE INVENTION

Accordingly, the main object of the present invention is to obviate the above-mentioned problems of the conventional softening technique for cotton fabrics and to provide an additive composition for a granular detergent capable of providing an excellent soft finish and feeling in fabrics, especially cotton fabrics during a fabric laundering operation.

Other objects and advantages of the present invention will be apparent from the following description.

In accordance with the present invention, there is provided an additive composition for a granular detergent comprising:

(a) a cationic surfactant having the general formula (I):

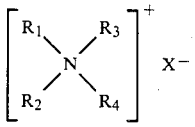

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 5 mole oxyalkylene units, and X represents a halogen atom,

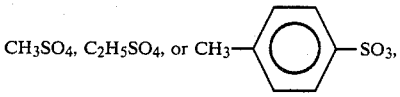

and (b) a nonionic cellulose derivative, the ratio of component (a)/component (b) in a weight basis of 99.9/0.1 to 50/50.

DESCRIPTION OF THE PREFERRED EMBODIMENTS

Typical examples of the quaternary ammonium salts represented by the general formula (I) as component (a) in the present invention are:

(1) distearyl dimethyl ammonium salts;
(2) dihydrogenated tallow alkyl dimethyl ammonium salts;
(3) dihydrogenated tallow alkyl benzyl methyl ammonium salts;
(4) distearyl methyl benzyl ammonium salts;
(5) distearyl methyl hydroxyethyl ammonium salts;
(6) distearyl methyl hydroxypropyl ammonium salts; and
(7) distearyl dihydroxyethyl ammonium salts.

Typical counter ions of the quaternary ammonium salts are chloride and bromide. Commercially available quaternary ammonium salts generally contain lower alcohol such as ethanol and propanol, and water. However, the contents of lower alcohols and water in quaternary ammonium salts are desirably as low as possible from the standpoint of physical properties (e.g., free flowing properties and storage stability) of the resultant granular detergent. These quaternary ammonium salts can be used alone or in any mixture thereof.

Typical examples of the non-ionic cellulose derivatives usable as component (b) in the present invention are methyl cellulose (MC), hydroxyethyl cellulose (HEC), hydroxypropyl cellulose (HPC), ethyl cellulose (EC), hydroxypropylmethyl cellulose (HPMC), and hydroxyethylmethyl cellulose (HEMC), although other non-ionic cellulose derivatives can be used in the present invention. These non-ionic cellulose derivatives can be used alone or any mixture thereof. Of these non-ionic cellulose derivatives, MC, HPMC, and HEMC having a methoxy content in the molecule of 20% to 30% by weight and a viscosity of a 2% by weight aqueous solution thereof of 1000 cps or more at 20° C.

The weight ratio of (a) the quaternary ammonium salts to (b) the non-ionic cellulose derivatives (i.e., (a)/(b)) in the present additive composition should be 99.9/0.1 to 50/50, desirably 99.5/0.5 to 75/25. The ratio (a)/(b) of more than 99.9/0.1 results in insufficient softening effects in cotton fabrics, whereas the ratio (a)/(b) of less than 50/50 decreases the desired softening effects in synthetic fiber fabrics.

The components (a) and (b) in the present additive composition are desirably mixed as uniform as possible and desirably granulated before their incorporation into granular detergents. For example, the granulation of the present additive composition can be carried out as follows. The quaternary ammonium salts are melted upon heating and, then, the non-ionic cellulose derivatives are added to the molten quaternary ammonium salts. The mixture is thoroughly mixed and is granulated either by spraying followed by cooling or solidifying upon cooling followed by crushing.

The average diameter of the granules or powder particles of the present additive composition is desirably 500 μm or less. Too large an average diameter of the particles of the present additive composition tends to cause not only difficulties in the provision of uniform softening effects on fabrics to be washed, but also a deposition of the particles of the addition composition per se on fabrics after washing.

The additive compositions for granular detergent according to the present invention can be incorporated into any conventional granular detergents generally in an amount of 0.1% to 20% by weight, desirably 0.5% to 10% by weight, in terms of the amount of the quaternary ammonium salt, based on the amount of the granular detergent. The addition amount of the present additive composition of less than 0.1% by weight in terms of the amount of the quaternary ammonium salt results in insufficient softening effects, whereas the addition amount of more than 20% by weight decreases detergency (or detergent power) and foaming (or lathering) characteristics.

The additive composition of the present invention is generally used after being incorporated into granular detergents, especially those containing as a main ingredient anionic surfactants. However, the additive composition of the present invention can be used alone without using the same in combination with granular detergents.

According to the use of the present additive composition, an excellent soft finish can be obtained in cotton fabrics as well as synthetic fiber fabrics.

EXAMPLE

The present invention now will be further illustrated by, but is by no means limited to, the following examples, in which all percentages are expressed on a weight basis unless otherwise specified.

EXAMPLES 1 TO 12

The fabric-softening effects of various additive compositions for detergents were evaluated in the following manner.

Dihydrogenated tallow alkyl dimethyl ammonium chloride in the form of powder (Arquad 2HT, 91% purity available from Lion Akzo Co., Ltd.) was melted at a temperature of 100° C. Then, various non-ionic cellulose derivatives listed in Table 1 were separately added to the molten quaternary ammonium salt and the mixture was thoroughly mixed for 10 minutes. Thereafter, the mixture was cooled to room temperature. The resultant blocks were crushed and ground to form powder particles having an average diameter of 250 μm. Thus, various samples of the additive compositions of the present invention were obtained.

These additive composition samples were separately incorporated into a granular detergent having the following compositions.

| Composition of granular detergent | % |
|---|---|
| Linear sodium alkylbenzene sulphonate ($C_{12}$ alkyl) | 20 |
| Sodium silicate | 10 |
| Sodium carbonate | 10 |
| Zeolite (type A, average particle diameter = 2 μm) | 20 |
| Carboxymethyl cellulose | 0.7 |
| Soap (tallow fatty acid) | 0.8 |
| Sodium sulfate and water | balance |

The fabric-softening effects of these detergent compositions were evaluated by washing sample fabrics therewith. Sample fabrics used are as follows:

| | |
|---|---|
| Nylon tricot cloth (30 denier) | 30 g × 4 pieces |
| Acrylic jersey cloth | 90 g × 2 pieces |
| Cotton towel | 80 g × 2 pieces |
| Bleached cotton cloth | 50 g × 4 pieces |
| Cotton knitted cloth | 85 g × 4 pieces |

The soiled sample fabrics were first washed in a wash liquid containing 0.13% of the above-mentioned granular detergent in tap water (or city water) at a temperature of 60° C. for 15 minutes. The sample fabrics were then rinsed with tap water at a temperature of 60° C. three times for 3 minutes each. The sample fabrics thus pre-treated were then placed into a jet type domestic electric washing machine and washed in a wash liquid containing the above-mentioned granular detergent and each additive composition listed in Table 1 in tap water for 10 minutes under the conditions of a liquid temperature of 25° C., a detergent concentration of 0.13%, and a bath ratio (i.e., a ratio of the washing liquid volume to the fabrics volume) of 30, followed by dewatering for 1 minute. Then, the washed sample fabrics were rinsed with tap water at a temperature of 25° C. for 3 minutes, followed by dewatering for 1 minute. This operation was repeated once more. Thereafter, the sample fabrics were air dried for 24 hours and, then, the air dried sample fabrics were conditioned under the conditions of a temperature of 25° C. and a relative humidity (RH) of 65%.

The cotton towels were sampled from the sample fabrics obtained above and fabric-softening effects of the additive compositions listed in Table 1 were evaluated by a sensory test using a panel consisting of 5 members (tactile impression). The results were scored on average as follows. The tactile impression of the same cotton towels treated in the same manner as mentioned above, except that no additive composition was used, was standardized as zero (0).

| Impression | Score |
|---|---|
| Excellently soft | 5 |
| Very soft | 4 |
| Soft | 3 |
| Fairly soft | 2 |
| Slightly soft | 1 |
| The test results are shown in Table 1. | |

TABLE 1

| Example No. | Cellulose Derivative Type | Ratio*1 | Compounding amount*2 (%) | Softening effect |
|---|---|---|---|---|
| 1*3 | — | — | 0 | 0 |
| 2*3 | — | — | 5 | 2 |
| 3 | MC (Marpolose M-10000) | 75/25 | 5 | 4 |
| 4 | MC (Marpolose 90MP-30,000) | 75/25 | 5 | 5 |
| 5 | MC (Marpolose 90MP-30,000) | 90/10 | 5 | 4 |
| 6 | HEC (Fuji HEC A-5000F) | 75/25 | 5 | 3 |
| 7 | HEC (Fuji HEC AW-15F) | 75/25 | 5 | 4 |
| 8 | HEC (NATROSOL H4) | 75/25 | 5 | 3 |
| 9 | HEC (NATROSOL HH) | 75/25 | 5 | 4 |
| 10 | HPC (Nisso HPC H) | 75/25 | 5 | 3 |
| 11 | HPC (KLUCEL HW) | 75/25 | 5 | 4 |
| 12 | HPC (KLUCEL H) | 75/25 | 5 | 4 |

*1Weight ratio of quaternary ammonium salt/cellulose derivative

*2Amount of additive composition in terms of quaternary ammonium salt based on granular detergent

*3Comparative example (no additive composition was used in example 1 and an additive composition not containing cellulose additive was used in example 2)

I claim:

1. An additive composition for a granular detergent comprising:

(a) A quaternary ammonium salt having the general formula (I):

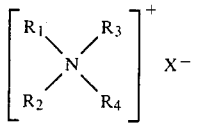

(I)

wherein $R_1$ and $R_2$ independently represent an alkyl group having 12 to 26 carbon atoms, $R_3$ and $R_4$ independently represent an alkyl group having 1 to 4 carbon atoms, a benzyl group, a hydroxyalkyl group having 2 to 4 carbon atoms, or a polyoxyalkylene group having 1 to 5 mole oxyalkylene units, and X represents a halogen atom, $CH_3SO_4$, $C_2H_5SO_4$, or $CH_3$— 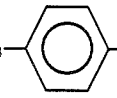 —$SO_3$, and (b) a nonionic cellulose derivative, the ratio of component (a)/component (b) in a weight basis of 99.9/0.1 to 50/50, said additive composition being granulated from a mixture of the molten quaternary ammonium salt having the general formula (I) and the nonionic cellulose derivative by (i) spraying the mixture, followed by cooling or (ii) solidifying the mixture upon cooling, followed by crushing.

2. An additive composition as claimed in claim 1, wherein the quaternary ammonium salt is at least one member selected from the group consisting of dihydrogenated tallow alkyl dimethyl ammonium chloride, distearyl dimethyl ammonium chloride, and dihydrogenated tallow alkyl benzyl methyl ammonium chloride.

3. An additive composition as claimed in claim 1, wherein the non-ionic cellulose derivative is at least one member selected from the group consisting of methyl cellulose, hydroxyethyl cellulose, and hydroxypropyl methyl cellulose.

4. An additive composition as claimed in claim 1, wherein the weight ratio of component (a)/component (b) is 99.5/0.5 to 75/25.

* * * * *